US006837300B2

(12) United States Patent
Cooper et al.

(10) Patent No.: US 6,837,300 B2
(45) Date of Patent: Jan. 4, 2005

(54) LUBRICANT CONTROL SYSTEM FOR METAL CASTING SYSTEM

(75) Inventors: Timothy James Cooper, Rathdrum, ID (US); Brett Thielman, Spokane, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 10/272,512

(22) Filed: Oct. 15, 2002

(65) Prior Publication Data

US 2004/0069435 A1 Apr. 15, 2004

(51) Int. Cl.[7] ..... B22D 11/12
(52) U.S. Cl. ..... 164/268; 164/267; 164/472
(58) Field of Search ..... 164/168, 167, 164/472, 268, 267

(56) References Cited

U.S. PATENT DOCUMENTS 3,814,166 A * 6/1974 Watts ..... 164/472
5,076,343 A * 12/1991 Sandercock ..... 164/267
6,079,693 A * 6/2000 Ettinger et al. ..... 251/195
6,491,087 B1 * 12/2002 Tilak ..... 164/444

* cited by examiner

*Primary Examiner*—Kiley S. Stoner
*Assistant Examiner*—I.-H. Lin
(74) *Attorney, Agent, or Firm*—Wells St. John P.S.

(57) ABSTRACT

A lubrication control system for use with or in a metal casting mold. Aspects of the invention include a lubricant flow stop or plug which prevents or controls the flow of lubricant from the mold during non-casting times.

16 Claims, 9 Drawing Sheets

LUBRICANT CONTROL SYSTEM FOR METAL CASTING SYSTEM

CROSS REFERENCE TO RELATED APPLICATION

This application does not claim priority from any other application.

TECHNICAL FIELD

This invention pertains to a lubricant control system for use with or in a metal mold or casting system. More particularly, this invention provides a lubricant control system which controls the fluid, preferably lubrication, which is provided to the mold and castpart during the casting process, especially before and/or after the casting of the metal.

BACKGROUND OF THE INVENTION

Metal ingots, billets and other castparts are typically formed by a casting process, which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation aluminum, brass, lead, zinc, magnesium, copper, steel, etc., the examples given and preferred embodiment disclosed may be directed to aluminum, and therefore the term aluminum may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart or billet 113 being partially formed. Ingot 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block typically used when an ingot is being cast and starting head when a billet is being cast.

While the starting block base 108 in FIG. 1 only shows one starting block 108 and pedestal 115, there are typically several of each mounted on each starting block base, which simultaneously cast billets, special shapes or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a pre-determined rate, thereby lowering the ram 106 and consequently the starting block at a pre-determined and controlled rate. The mold is controllably cooled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

Mold tables come in all sizes and configurations because there are numerous and differently sized and configured casting pits over which mold tables are placed. The needs and requirements for a mold table to fit a particular application therefore depends on numerous factors, some of which include the dimensions of the casting pit, the location (s) of the sources of water and the practices of the entity operating the pit.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired shape. There is an air gap between the emerging solidified metal and the permeable ring wall. Below that, there is also a mold air cavity between the emerging solidified metal and the lower portion of the mold and related equipment.

Since the casting process generally utilizes fluids, including lubricants, there is necessarily conduits and/or piping designed to deliver the fluid to the desired locations around the mold cavity. Although the term lubricant will be used throughout this specification, it is understood that this also means fluids of all types, whether a lubricant or not.

After a particular cast is completed, as described above, the mold table is typically tilted upward and away from the top of the casting pit, as shown in FIG. 1. When the mold table is tilted or pivoted, and without a lubricant control system, the lubricant tends to drain out of the conduits and leaks either into the casting pit or on the floor of the casting facility.

The drainage of the lubricant after and before a casting is generally undesirable from a cleanup and from a startup perspective. The cleanup perspective is self-evident, and the startup process may then require that the conduits again be refilled with lubricant or fluid before the next ingot or billet may be cast.

Some prior art systems have recognized the undesirability of this lubricant drainage, and attempted to solve the problem by providing channels or other containers to catch the draining lubricant. This may reduce the cleanup issue, but does not address the startup problem.

It is therefore an object of this invention to provide an improved lubricant/fluid control system for use in metal casting systems.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
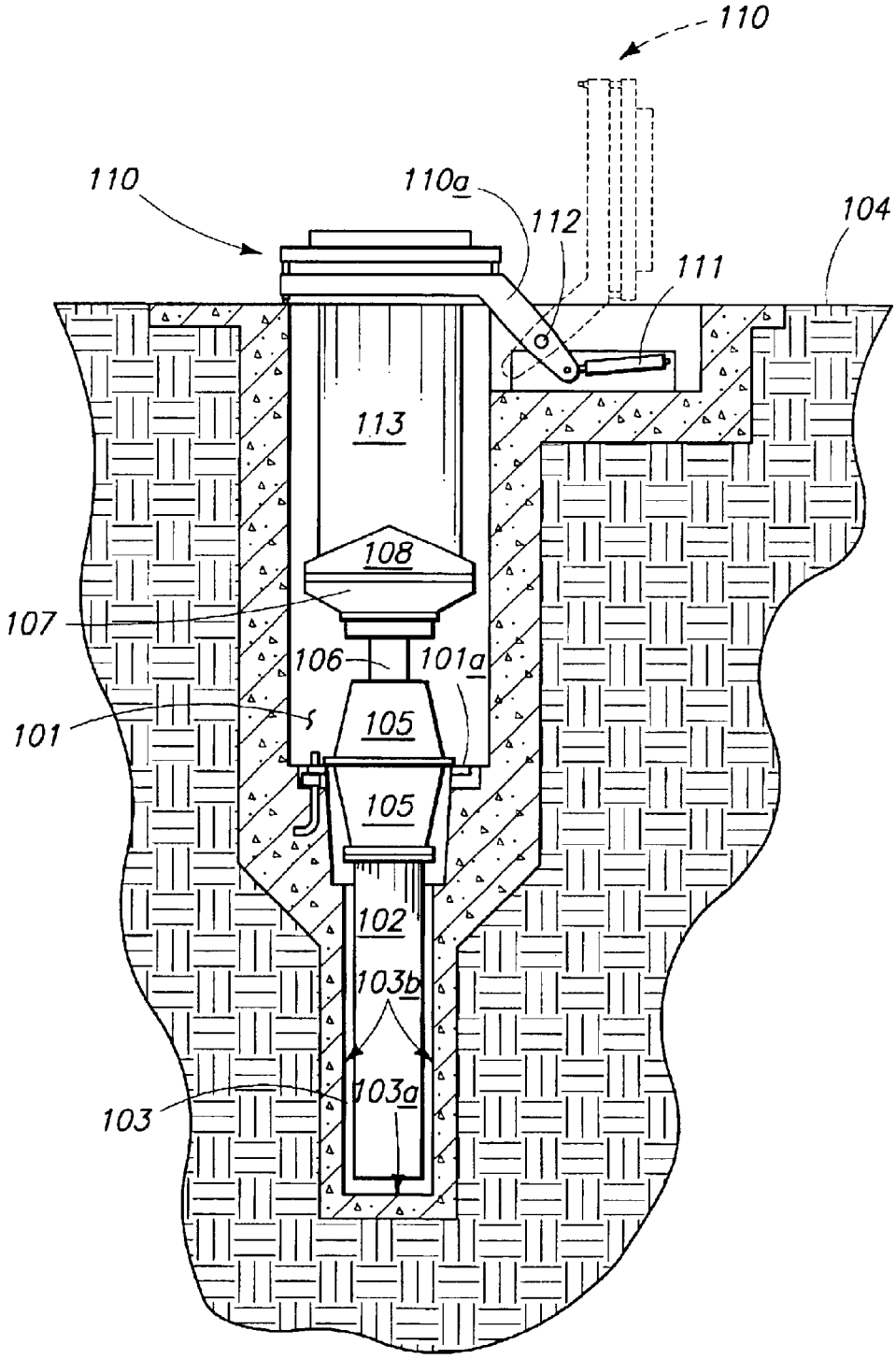
FIG. 1 is an elevation view of a typical vertical casting pit, caisson and metal casting apparatus.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention applies to and can be utilized in connection with various types of metal pour technologies and configurations. It is further to be understood that this invention may be used on horizontal or vertical casting devices.

The mold therefore must be able to receive molten metal from a source of molten metal, whatever the particular source type is. The mold cavities in the mold must therefore be oriented in fluid or molten metal receiving position relative to the source of molten metal.

Those skilled in the art will appreciate there may be many examples of embodiments within the contemplation of this invention for achieving biasing forces and balancing forces, and causing the lubricant flow stop device to block the flow of lubricant through or out of the lubricant flow cavity, a few of which are given below.

It will also be appreciated by those of ordinary skill in the art that embodiments of this lubricant control system may and will be combined with existing systems and/or retrofit to existing operating casting systems, all within the scope of this invention.

It will be appreciated by those of ordinary skill in the art that embodiments of this lubricant control system may include a lubricant plug positioned within one or more of the lubricant conduits and/or adjacent one or more of the lubricant conduits.

In some embodiments of this invention, an expandible bladder may be placed in or near one or more lubrication conduits, and in other embodiments there may be an intermediate plug or stop which is directly or indirectly moved or positioned to cause the flow of lubricant to flow or cease flowing, depending on the application and on the biasing of the system.

It will also be appreciated by those of ordinary skill in the art that the plug or lubricant flow stop means need not be a complete barrier across one or more lubricant conduits, but instead may be a partial barrier, a membrane, or a conduit or plug configuration which creates a capillary action, according to Darby's law and those ways known by those of ordinary skill in the art.

FIG. 1 is an elevation view of a typical vertical casting pit, caisson and metal casting apparatus, and is described in more detail above.

Figure 2:
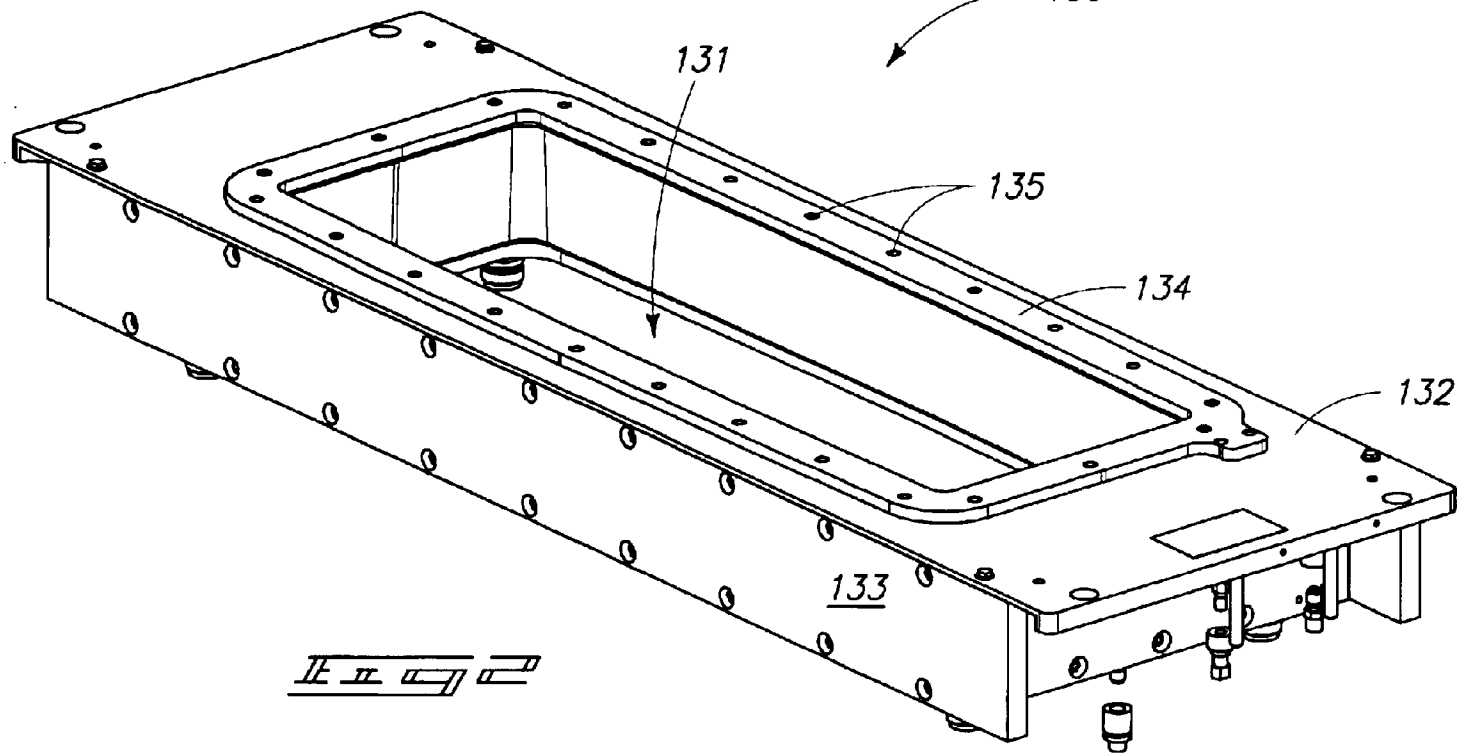
FIG. 2 is a perspective view of one of the numerous mold frameworks with which embodiments of this invention may be utilized.

FIG. 2 is a perspective view of one of the numerous mold frameworks with which embodiments of this invention may be utilized, illustrating mold 130 with mold framework 132, mold cavity or mold bore 131, lubricant cover 134 with apertures 135, and sidewall 133.

Figure 3:
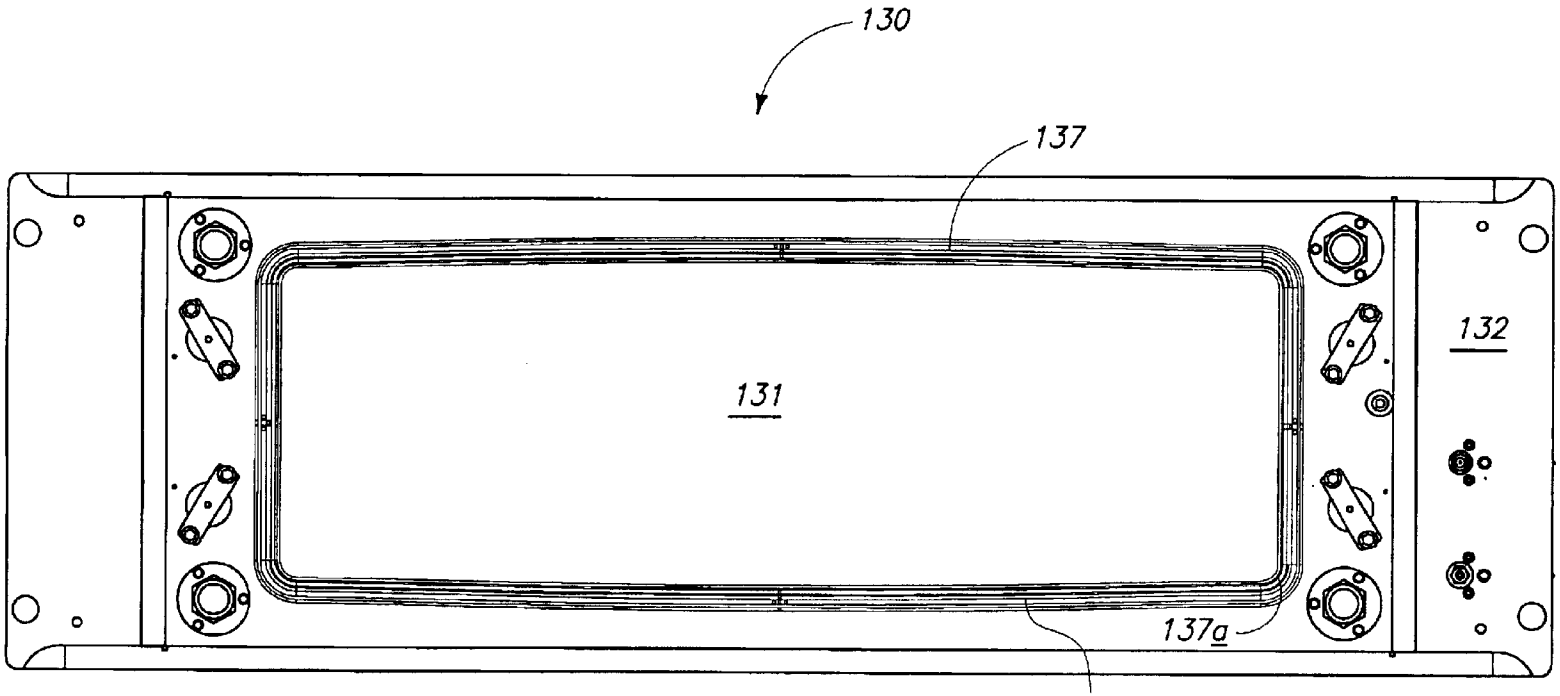
FIG. 3 is a bottom view of the mold framework illustrated in FIG. 2.

FIG. 3 is a bottom view of the mold framework illustrated in FIG. 2, showing mold 130, mold framework 132, an embodiment of a bladder 137 positioned around the inner perimeter of the mold bore 131.

Figure 4:
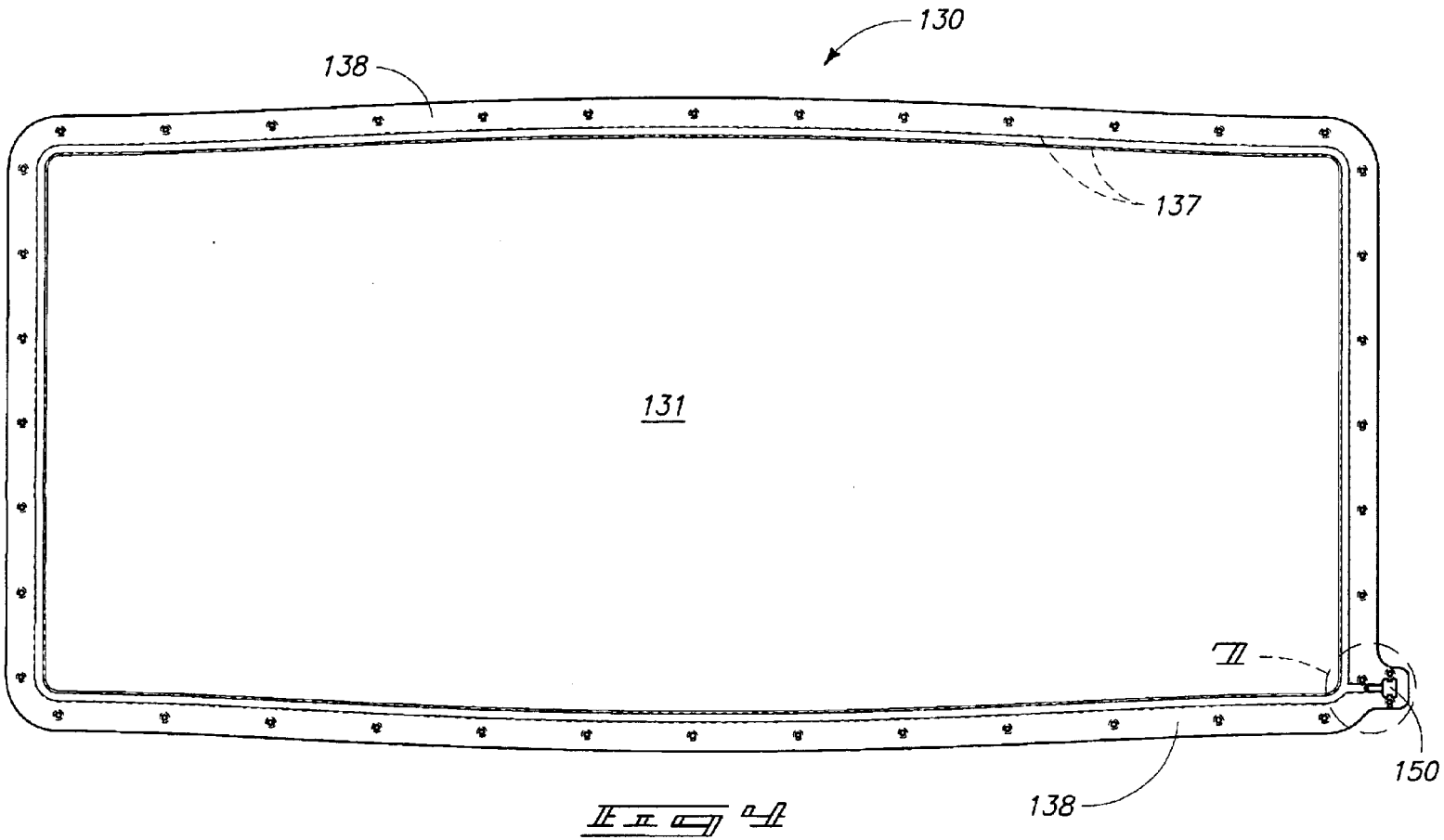
FIG. 4 is a bottom view of a lubricant cover which may be utilized with the mold framework shown in FIG. 2.

FIG. 4 is a bottom view of a lubricant cover 134 which may be utilized with the mold framework shown in FIG. 2, showing mold bore 131, lubricant cover framework 138 and bladder aperture 137 for housing an embodiment of the bladder illustrated in FIGS. 8 and 9 below. It will be noted that the bladder aperture generally encircles the inner perimeter of the lubricant cover 138 and the mold framework for that matter.

Figure 5:
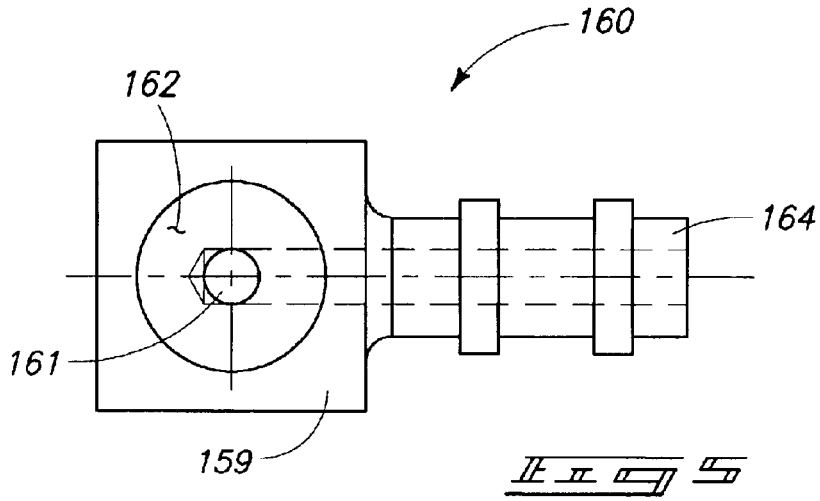
FIG. 5 is a top view of an embodiment of a bladder manifold which may be utilized in combination with the bladder illustrated in FIGS. 8 and 9.
Figure 8:
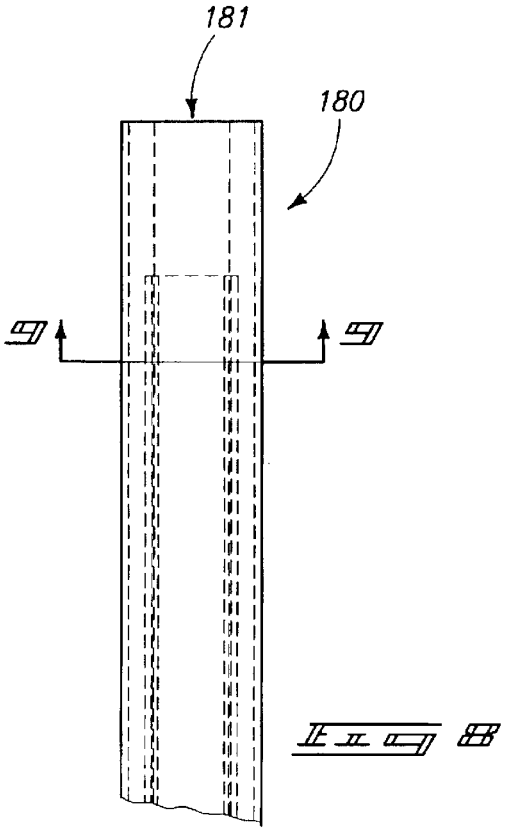
FIG. 8 is a top view of an embodiment of a bladder which may be utilized in embodiments of this invention.
Figure 9:
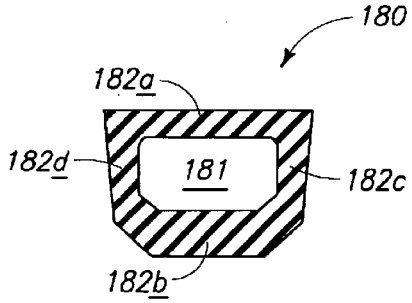
FIG. 9 is section 9—9 of the bladder illustrated in FIG. 8.

FIG. 5 is a top view of an embodiment of a bladder manifold 160 which may be utilized in combination with the bladder illustrated in FIGS. 8 and 9, showing manifold body 159, lubricant aperture 161, O-ring 162 and bladder insert 164 which inserts in a flexible or semi-flexible bladder like that illustrated in FIGS. 8 & 9, and also assists in the retention of the bladder to the manifold 160.

Figure 6:
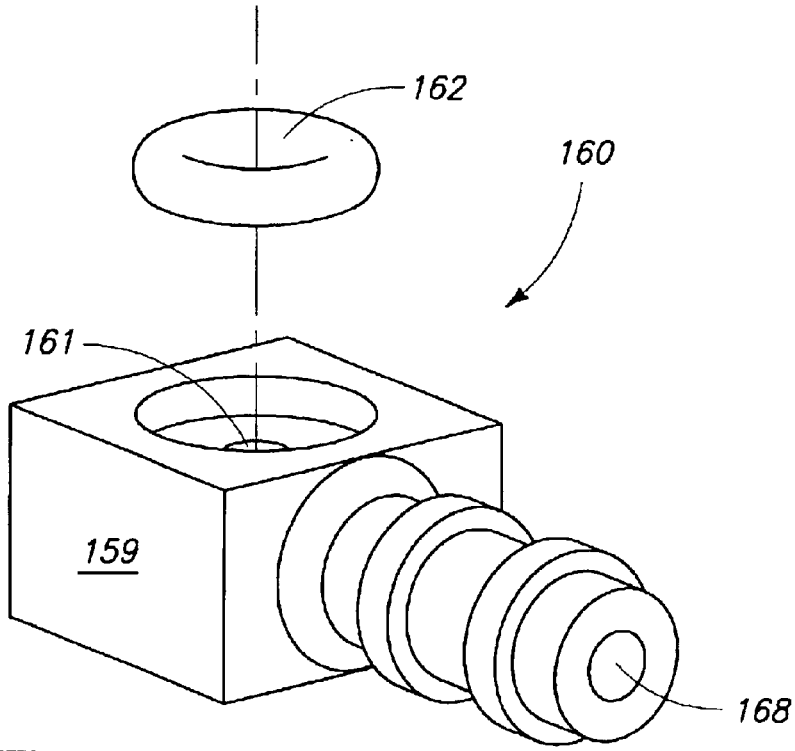
FIG. 6 is a perspective view of the embodiment of the bladder manifold illustrated in FIG. 5.

FIG. 6 is a perspective view of the embodiment of the bladder manifold illustrated in FIG. 5, showing manifold body 159, lubricant aperture 161, O-ring 162 and bladder insert aperture 168. The manifold shown may be the exclusive or a non-exclusive manifold for a given ingot mold for instance. Lubricant aperture 161 in manifold 160 is where a fluid (preferably air) supply line fitting would be attached to the manifold for the delivery of fluid into the internal cavity of the bladder.

Figure 7:
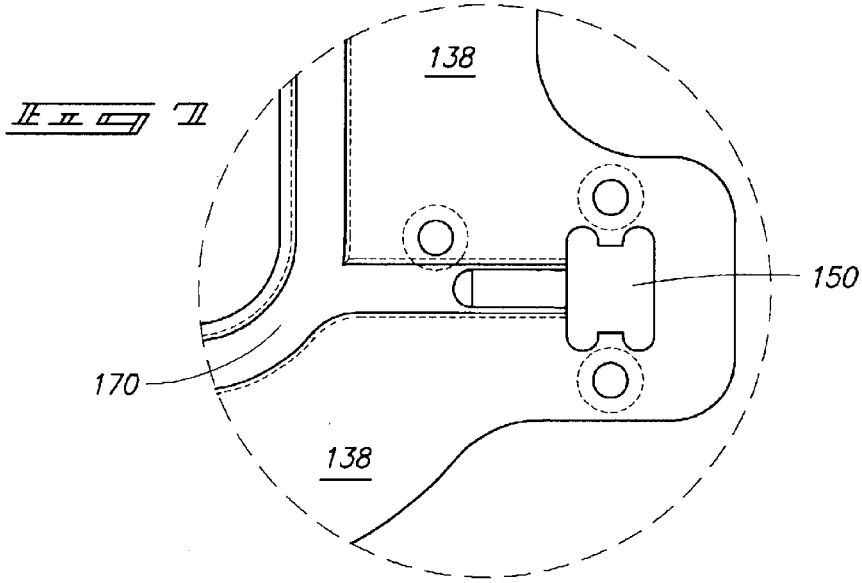
FIG. 7 is detail 7 from FIG. 4.

FIG. 7 is detail 7 from FIG. 4, illustrating lubricant cover framework 138, bladder aperture 179 and fluid inlet 150. It will be appreciated by those of ordinary skill in the art that there are a number of different ways that fluid may be routed to and/or through the mold framework and/or the bladder in the lubricant cover 138, all generally known in the art and no one in particular required to practice embodiments of this invention.

FIG. 8 is a partial top view of an embodiment of a bladder 180 which may be utilized in embodiments of this invention, illustrating a first end 185 which may be sealed off, an internal cavity 181 and bladder body 182.

FIG. 9 is section 9—9 from FIG. 8, of the bladder 180 illustrated in FIG. 8, illustrating bladder body 182 with a first side 182*a*, a second side 182*b*, a third side 182*c* and a fourth side 182*d*. It will be appreciated by those of ordinary skill in the art that the particular shape and configuration of a bladder may be any variety of shapes, so long as it actuates the stopping of the flow or lubricant when desired. Later figures herein illustrate some of the other possible configurations as examples. FIG. 9 also shows internal cavity 181 of the embodiment of the bladder 180.

If a bladder is used as part or all of the lubricant control system in an embodiment of this invention, it may any one of a number of different sizes and materials. For example, one bladder which may be utilized may be made of silicon, fifty durometer, with one or more ends vulcanized. The bladders may actually contain any type of gaseous or liquid fluid in the internal cavities thereof, with air being preferred.

Figure 10:
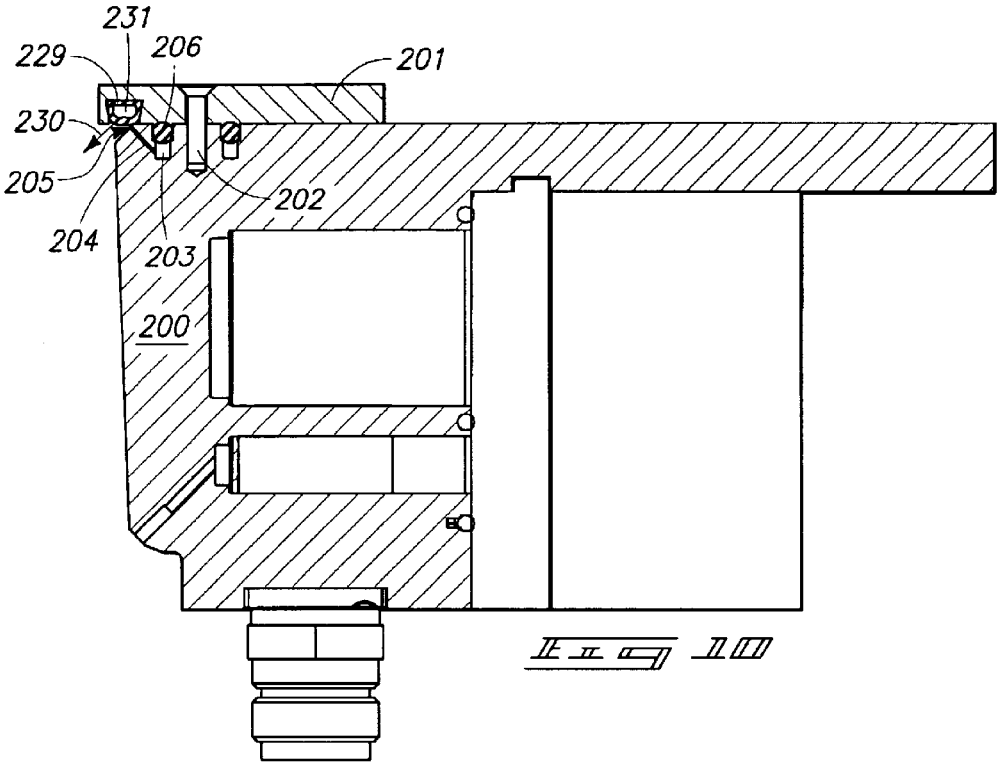
FIG. 10 is a partial cross-section view of an embodiment of a oil cover on a mold cover framework, which may be utilized in a mold framework, with one embodiment of a lubricant control system contemplated by this invention, shown therein.

FIG. 10 is a cross-section view of an embodiment of a oil cover 170 and mold framework which may be utilized to practice an embodiment of a lubricant control system contemplated by this invention, illustrating a bladder aperture in the oil cover into which a bladder 229 such as shown in FIG. 8 may be inserted to provide the blockage of the lubricant delivery holes. The bladder 229 is similar to that shown in FIGS. 8 & 9, and has an internal cavity 231 which receives a source of air which causes it to expand in the direction of arrow 230. The expansion of the bladder 229 causes an outer surface to expand over the lubricant outlet 205.

FIG. 10 also shows mold framework 200, lubricant cover 201, lubricant conduit 203 with lubricant conduit O-ring 205, and lubricant distribution aperture 204. The general configuration of mold tables and mold frameworks are well known by those of ordinary skill in the art and will not therefore be described in more detail herein.

The lubricant outlet 205 is one of many that surround the mold cavity or bore, and provide the outlet through which the lubricant is provided.

It should be noted that there are multiple aspects within the contemplation of this invention, which may be used to provide a lubricant control system, only some of which will be shown in the figures described below. Furthermore the internal cavity of the bladder will be operatively connected to a source of compressed gas, preferably air, which will be utilized to expand the bladder to control the flow of lubricant, all of which are well known in the art and a more detailed description is not required herein.

The oil or lubricant delivery systems with which embodiments of this lubricant control system may be used are also well known to those of ordinary skill in the art, and will not therefore be described in further detail.

Figure 11:
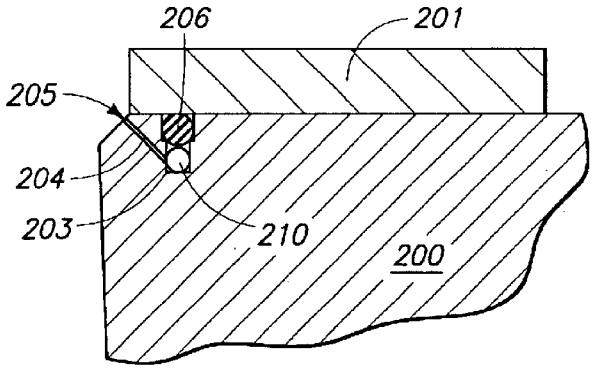
FIG. 11 is a detail cross-section view of an alternative embodiment of a lubricant control system which may be utilized in practicing of this invention.

FIG. 11 is a detail cross-section view of an alternative embodiment of a lubricant control system which may be utilized in practicing of this invention, showing mold framework 200, lubricant cover 201, lubricant conduit 203 with lubricant conduit O-ring 205, and lubricant distribution aperture 204. FIG. 11 shows bladder 210 expanded within lubricant conduit 203, and configured in such a way as to prevent the flow of lubricant through lubricant distribution aperture 204 when expanded, but to allow the flow of lubricant when the bladder 210 is contracted as shown in FIG. 12.

Figure 12:
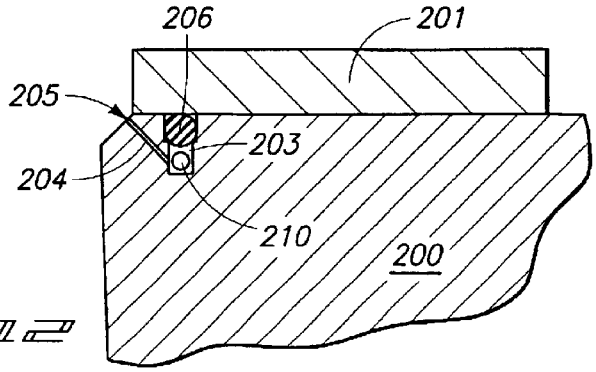
FIG. 12 is a detail cross-section view of the embodiment of the lubricant control system illustrated in FIG. 11, only wherein the bladder is contracted within the lubricant.

FIG. 12 is a detail cross-section view of the embodiment of the lubricant control system illustrated in FIG. 11, only wherein the bladder 210 is contracted. The bladder 210 may be expanded and contracted in any one of a number of different ways, including through the introduction of air under pressure at a sufficient pressure in an internal cavity of the bladder 210 to cause the expansion of the bladder body. When expanded, the bladder blocks the flow of lubricant through the lubricant delivery apertures, and when contracted, it does not prevent the flow. FIG. 12 also shows mold framework 200, lubricant cover 201, lubricant conduit 203 with lubricant conduit O-ring 205, and lubricant distribution aperture 204.

Figure 13:
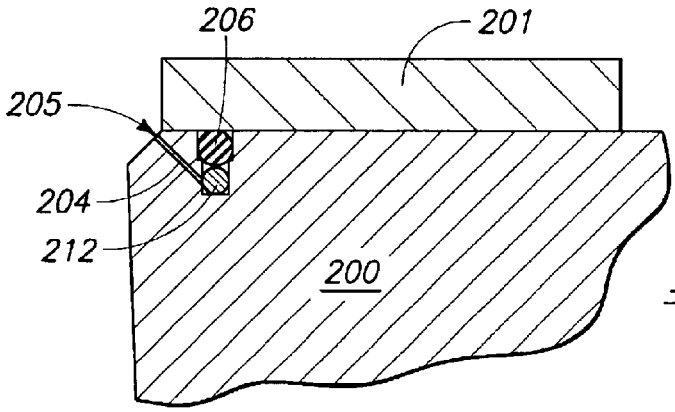
FIG. 13 is a detail cross-section view of an alternative embodiment of a lubricant control system which may be utilized in practicing this invention, showing a porous plug across the lubricant delivery aperture.

FIG. 13 is a detail cross-section view of an alternative embodiment of a lubricant control system which may be utilized in practicing this invention, showing a porous membrane 212 or barrier across the lubricant conduit. The specific type of membrane would be a design choice based on the type of the lubricant, the pressures of delivery, and others. FIG. 13 also shows mold framework 200, lubricant cover 201, lubricant conduit 203 with lubricant conduit O-ring 205, and lubricant distribution aperture 204.

Figure 14:
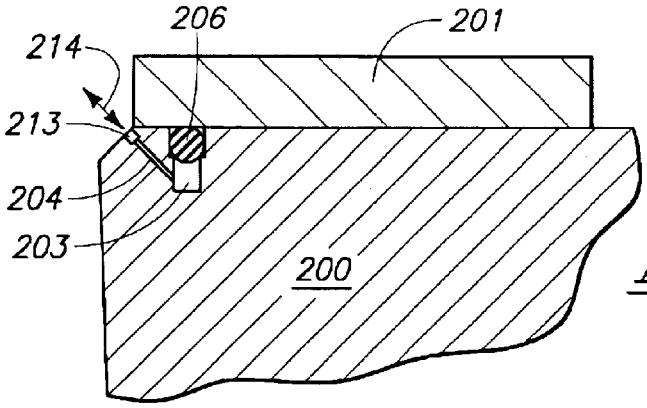
FIG. 14 is a detail cross-section view of an alternative embodiment of a lubricant control system which may be utilized in practicing this invention, showing an individual check valve or flow stop valve in the lubricant delivery aperture, which may be located at the entrance or exit of the aperture.

FIG. 14 is a detail cross-section view of an alternative embodiment of a lubricant control system which may be utilized in practicing this invention, showing an individual check valve or flow stop valve in the lubricant delivery aperture. Check valves are generally known and any one of a number of different types of valves may be utilized, the preferable type being pressure activated in this instance. The valve 213 or plug would be activated and moved in the direction of arow 214 when sufficient lubricant pressure is generated to overcome the bias of the valve 213.

FIG. 14 also shows mold framework 200, lubricant cover 201, lubricant conduit 203 with lubricant conduit O-ring 205, and lubricant distribution aperture 204.

Figure 15:
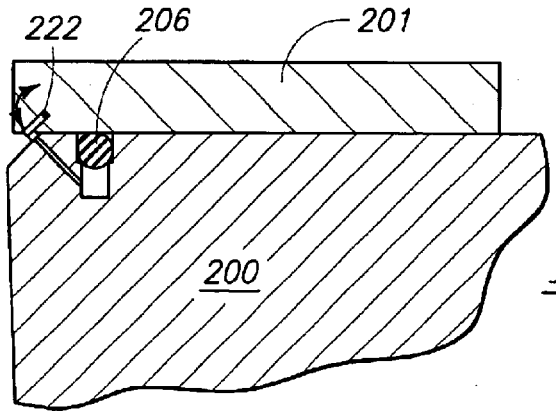
FIG. 15 is a detail cross-section view of an alternative embodiment of a lubricant control system which may be utilized in practicing this invention, showing a pivotally mounted lubricant delivery aperture plug mounted to or within the lubricant cover.

FIG. 15 is a detail cross-section view of an alternative embodiment of a lubricant control system which may be utilized in practicing this invention, showing a pivotally mounted lubricant delivery plug 222 mounted to or within the lubricant or oil cover 201. This type of pivotally mounted plug 222 may be bias mounted in the closed position such that the lubricant pressure must overcome the bias to exit the lubricant outlet. It should also be noted that the pivotally mounted plug 222 may be utilized in combination with a bladder such as shown in FIG. 10 such that the inflation or expansion of the bladder forces the plug 222 to cover or block the flow of lubricant out of the lubricant delivery aperture 204.

FIG. 15 also shows mold framework 200, lubricant cover 201, lubricant conduit 203 with lubricant conduit O-ring 205, and lubricant distribution aperture 204.

Figure 16:
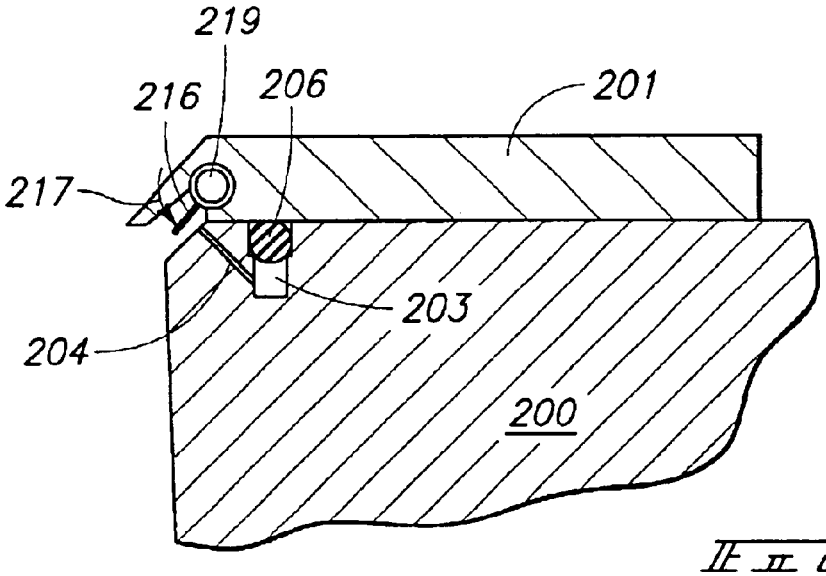
FIG. 16 is a detail cross-section view of an alternative embodiment of a lubricant control system which may be utilized in practicing this invention, showing a bladder combined with a plug which prevents the flow of lubricant when the bladder is expanded.

FIG. 16 is a detail cross-section view of an alternative embodiment of a lubricant control system which may be utilized in practicing this invention, showing a bladder combined with a plug which prevents the flow of lubricant when the bladder is expanded. FIG. 16 also shows mold framework 200, lubricant cover 201, lubricant conduit 203 with lubricant conduit O-ring 205, and lubricant distribution aperture 204.

It should be noted that embodiments of this invention may be varied, such as by providing a system which is biased or defaults to the open or closed condition of the lubricant delivery aperture. For instance in the embodiment shown in FIG. 16, the normal or default status of the bladder, may either be expanded or contracted with the aperture plug 216 or cover, positioned to either allow the flow or prevent the flow. If the default is selected to be closed, the bladder 219 is in a state to maintain the aperture plug 216 over the outlet 205 of the lubricant delivery aperture, thereby preventing the flow of lubricant. In this embodiment, when the casting process begins, the system is activated to cause the aperture plug 216 to move away from the outlet 205, i.e. a normally closed embodiment. It will be appreciated by those of ordinary skill in the art that a normally open embodiment may also be utilized within the contemplation of this invention.

Figure 17:
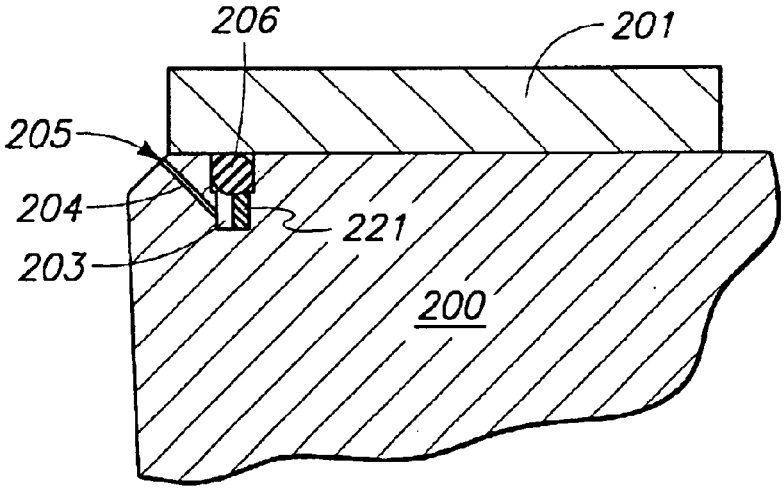
FIG. 17 is a detail cross-section view of an alternative embodiment of a lubricant control system which may be utilized in practicing this invention.

A barrier 221 such as shown in FIG. 17 may have capillary type apertures which utilized the surface tension of the lubricant to prevent the flow through the capillary apertures until and unless the applicable surface tensions are overcome by the pressure of the lubricant.

FIG. 17 is a detail cross-section view of an alternative embodiment of a lubricant control system which may be utilized in practicing this invention, showing a barrier with flow apertures utilized, the flow apertures being sized to prevent lubricant flow when insufficient pressure is present, but to allow lubricant flow when the lubricant pressure is raised to a predetermined level.

FIG. 17 also shows mold framework 200, lubricant cover 201, lubricant conduit 203 with lubricant conduit O-ring 205, and lubricant distribution aperture 204.

On startup on a mold table or a mold, the lubricant is generally preferably introduced in the lubricant conduit and distributed around the mold cavity area at the same time. Then once the casting process begins, the lubricant is substantially uniform around the mold cavity, which tends to be closer to the desired simultaneous introduction of lubricant to the mold.

As will be appreciated by those of reasonable skill in the art, there are numerous embodiments to this invention, and variations of elements and components which may be used, all within the scope of this invention.

One embodiment of this invention, for example, is a lubricant control system for use with a metal casting mold, comprising: a lubrication conduit disposed to receive a flow of lubricant from a lubricant inlet and distribute lubricant to a lubricant outlet around a mold cavity; and a lubricant conduit plug disposed to prevent the flow of the lubricant through the lubricant outlet upon the occurrence of a pre-determined condition. In further embodiments thereof: the lubricant plug may be a check valve positioned within a lubricant conduit; the lubricant plug may be an expandible bladder positioned to plug the lubricant outlet when expanded and to allow flow through the lubricant outlet when contracted; the lubricant plug may be placed in a normally positioned within the lubricant conduit; and/or the lubricant plug may be normally positioned adjacent the lubricant conduit.

In another embodiment thereof, a lubricant control system is provided for use with a metal casting mold table, and comprises: a lubrication conduit disposed to receive a flow of lubricant from a lubricant inlet and distribute it to lubricant outlets around a mold cavity; and a lubricant flow stop means disposed near the lubricant outlet to prevent the flow of the lubricant back through the lubricant outlet upon the occurrence of a pre-determined condition. Further embodiments of this may be wherein: the lubricant flow stop means is disposed at the lubricant outlet; the lubricant conduit is integral in the casting mold; wherein the pre-determined condition occurs as a result of the termination of casting; further wherein the pre-determined condition occurs as a result of movement of a mold associated with the lubricant control system; and/or further wherein the pre-determined condition occurs to facilitate the movement of a mold associated with the lubricant control system.

In a further embodiment of the invention recited above, the lubricant control system may further include a plurality of lubricant outlets and a corresponding lubricant conduit plug; and in yet a further embodiment, the lubricant conduit plug may be an expandible bladder positioned to plug the plurality of lubricant outlets when expanded and to allow flow through the lubricant outlet when contracted.

In another embodiment of the invention, a metal mold is provided, the mold generally comprising: a mold framework with a mold bore for receiving molten metal; a lubricant control system integral with the mold framework, the lubricant control system comprising: a lubrication conduit disposed to receive a flow of lubricant from a lubricant inlet and distribute lubricant to lubricant outlets around a mold cavity; and a lubricant conduit plug disposed to prevent the flow of the lubricant through the lubricant outlet upon the occurrence of a pre-determined condition.

In a process embodiment of the invention, a method for controlling the lubricant in a metal casting mold is provided, the method comprising the following: providing a metal casting mold with a mold cavity, the metal casting mold including a plurality of lubricant conduits disposed to receive a flow of lubricant from a plurality of lubricant inlets and to distribute the lubricant to a plurality of lubricant outlets positioned around the mold cavity; providing at least one lubricant conduit plugs corresponding to the plurality of lubricant outlets, and disposed to prevent the flow of the lubricant through the plurality of lubricant outlets upon the occurrence of a pre-determined condition; and activating the lubricant conduit plugs to block the flow of lubricant through the plurality of lubricant outlets.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A lubricant control system for use with a metal casting mold, comprising:

a lubrication conduit disposed to receive a flow of lubricant from a lubricant inlet and distribute lubricant to a lubricant outlet around a mold cavity; and a lubricant conduit plug disposed to prevent the flow of the lubricant through the lubricant outlet upon the occurrence of a pre-determined condition.

2. A lubricant control system as recited in claim 1, and further wherein the lubricant plug is a check valve positioned within a lubricant conduit.

3. A lubricant control system as recited in claim 1, and further wherein the lubricant plug is an expandible bladder positioned to plug the lubricant outlet when expanded and to allow flow through the lubricant outlet when contracted.

4. A lubricant control system as recited in claim 3, and further wherein the lubricant plug is normally positioned within the lubricant conduit.

5. A lubricant control system as recited in claim 1, and further wherein the lubricant plug is normally positioned adjacent the lubricant conduit.

6. A lubricant control system as recited in claim 1, and further wherein there are a plurality of lubricant outlets and a corresponding lubricant conduit plug.

7. A lubricant control system as recited in claim 6, and further wherein the lubricant conduit plug is an expandible bladder positioned to plug the plurality of lubricant outlets when expanded and to allow flow through the lubricant outlet when contracted.

8. A lubricant control system as recited in claim 1, and further wherein the pre-determined condition occurs as a result of the termination of casting.

9. A lubricant control system for use with a metal casting mold table, comprising:

a lubrication conduit disposed to receive a flow of lubricant from a lubricant inlet and distribute it to lubricant outlets around a mold cavity; and a lubricant flow stop means disposed near the lubricant outlet to prevent the flow of the lubricant back through the lubricant outlet upon the occurrence of a pre-determined condition.

10. A lubricant control system as recited in claim 9, and further wherein the lubricant flow stop means is disposed at the lubricant outlet.

11. A lubricant control system as recited in claim 9, and further wherein the lubricant conduit is integral in the casting mold.

12. A lubricant control system as recited in claim 9, and further wherein the pre-determined condition occurs as a result of the termination of casting.

13. A lubricant control system as recited in claim 9, and further wherein the pre-determined condition occurs as a result of movement of a mold associated with the lubricant control system.

14. A lubricant control system as recited in claim 9, and further wherein the pre-determined condition occurs to facilitate the movement of a mold associated with the lubricant control system.

15. A metal mold comprising:

a mold framework with a mold bore for receiving molten metal;

a lubricant control system integral with the mold framework, the lubricant control system comprising:

a lubrication conduit disposed to receive a flow of lubricant from a lubricant inlet and distribute lubricant to lubricant outlets around a mold cavity; and a lubricant conduit plug disposed to prevent the flow of the lubricant through the lubricant outlet upon the occurrence of a pre-determined condition.

16. A method for controlling the lubricant in a metal casting mold, comprising the following:

providing a metal casting mold with a mold cavity, the metal casting mold including at least one lubricant conduit disposed to receive a flow of lubricant from at least one lubricant inlet and to distribute the lubricant to a plurality of lubricant outlets positioned around the mold cavity;

providing at least one lubricant conduit plug corresponding to the plurality of lubricant outlets, and disposed to prevent the flow of the lubricant through the plurality of lubricant outlets upon the occurrence of a pre-determined condition;

and activating the lubricant conduit plugs to block the flow of lubricant through the plurality of lubricant outlets.

* * * * *